US006796859B1

(12) United States Patent
Justen et al.

(10) Patent No.: US 6,796,859 B1
(45) Date of Patent: Sep. 28, 2004

(54) AIR INTAKE SILENCER

(75) Inventors: Thomas R. Justen, McHenry, IL (US); Edward K. Lam, Wadsworth, IL (US); Peter W. Meier, Stuart, FL (US); Donald Moore, Palm City, FL (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 09/714,316

(22) Filed: Nov. 16, 2000

(51) Int. Cl.[7] ..... B63H 21/36

(52) U.S. Cl. ..... 440/88 A; 440/88 R; 440/77; 181/206; 123/198 E

(58) Field of Search ..... 440/88 A, 88 R, 440/89 R, 89 J, 76, 77, 900, 88, 89; 123/184.39, 184.53–184.59, 198 E, 184.57, 229, 267, 268, 273, 275, 276; 181/206, 238, 240, 247, 248, 250, 251

(56) References Cited

U.S. PATENT DOCUMENTS

| | | | | | |
|---|---|---|---|---|---|
| 2,027,359 | A | * | 1/1936 | Wood et al. | 181/264 |
| 2,050,581 | A | | 8/1936 | Orem | |
| 2,323,955 | A | | 7/1943 | Wilson | |
| 2,580,655 | A | | 1/1952 | Chipley | |
| 2,798,470 | A | * | 7/1957 | Kiekhaefer | 123/198 E |
| 2,862,572 | A | | 12/1958 | Amlott | |
| 2,954,096 | A | | 9/1960 | McMullen | |
| 2,971,507 | A | * | 2/1961 | Kiekhaefer | 123/198 E |
| 3,195,530 | A | * | 7/1965 | Heidner | 123/198 E |
| 3,323,305 | A | * | 6/1967 | Klees | 60/469 |
| 3,557,902 | A | * | 1/1971 | Brown et al. | 181/229 |
| 3,568,791 | A | * | 3/1971 | Luxton | 181/224 |
| 3,610,198 | A | * | 10/1971 | Alexandrowicz | 440/77 |
| 3,614,859 | A | | 10/1971 | Clark | |
| 3,655,011 | A | * | 4/1972 | Willett | 181/228 |
| 3,951,566 | A | * | 4/1976 | Mattei et al. | 415/115 |
| 4,315,559 | A | | 2/1982 | Casey | |
| 4,326,600 | A | * | 4/1982 | Okazaki et al. | 181/229 |
| 4,538,556 | A | * | 9/1985 | Takeda | 123/184.57 |
| 4,570,744 | A | | 2/1986 | Hoshiba | |
| 4,734,070 | A | * | 3/1988 | Mondek | 440/88 |
| 4,846,300 | A | * | 7/1989 | Boda | 181/229 |
| 4,978,321 | A | * | 12/1990 | Ferguson | 440/88 |

(List continued on next page.)

FOREIGN PATENT DOCUMENTS

| | | | | | |
|---|---|---|---|---|---|
| DE | 2351669 | | * | 4/1975 | 181/273 |
| DE | 19543967 | A1 | * | 5/1987 | F02M/35/12 |
| DE | 4341951 | A1 | * | 6/1994 | F01N/1/06 |
| DE | 19543967 | | | 5/1997 | |
| DE | 19915524 | | | 10/2000 | |
| FR | 0716823 | | * | 12/1931 | 181/48 |
| GB | 2222852 | A | * | 3/1990 | F01N/1/06 |
| GB | 2222852 | | * | 3/1990 | 181/268 |
| JP | 57191409 | A | * | 11/1982 | F01N/1/06 |
| JP | 60-017226 | | * | 1/1985 | 123/184.39 |
| JP | 60-022021 | | * | 2/1985 | 123/184.39 |
| JP | 60073039 | A | * | 4/1985 | F02M/35/12 |
| JP | 61-030493 | | * | 2/1986 | 440/88 |
| JP | 61-057491 | | * | 3/1986 | 440/88 |
| JP | 01-170754 | | * | 7/1989 | 123/184.39 |
| JP | 401-253560 | | * | 10/1989 | 123/184.57 |

(List continued on next page.)

*Primary Examiner*—S. Joseph Morano
*Assistant Examiner*—Ajay Vasudeva
(74) *Attorney, Agent, or Firm*—BRP Legal Services

(57) ABSTRACT

An air intake silencer includes an air inlet pipe and at least one tuning tube in fluid communication with the air inlet pipe. A first length and second length of the air inlet pipe and the tuning tube, respectively, are selected to produce one-half wavelength cancellation of a selected frequency of engine noise. A plurality of tuning tubes located in a wrap-around relationship with on another may tune different frequencies of noise in a compact silencing unit. The air inlet pipe and tuning tube may be integrally formed into an air intake manifold that silences one or more engine air intake inlets, and the air intake silencer may be integrated into a motor cover.

22 Claims, 5 Drawing Sheets

U.S. PATENT DOCUMENTS 5,002,021 A * 3/1991 Nakata et al. ..... 123/184.42
5,033,581 A * 7/1991 Feuling ..... 181/257
5,083,538 A * 1/1992 Hubbell ..... 123/198 E
5,107,800 A * 4/1992 Araki et al. ..... 123/184.57
5,129,847 A * 7/1992 Mondek ..... 440/88
5,391,099 A * 2/1995 Allain ..... 440/77
5,417,195 A * 5/1995 Tachikawa et al. ..... 123/585
5,441,023 A * 8/1995 Ma ..... 123/184.57
5,445,547 A * 8/1995 Furukawa ..... 440/77
5,596,962 A * 1/1997 Tsunoda et al. ..... 123/184.39
5,660,571 A * 8/1997 Nakayasu et al. ..... 440/88
5,683,277 A * 11/1997 Tsunoda et al. ..... 440/88
5,996,546 A * 12/1999 Kollmann et al. ..... 123/195 C
6,009,705 A 1/2000 Arnott et al.
6,047,677 A * 4/2000 Kim ..... 123/184.55
6,099,372 A 8/2000 Toyama
6,112,514 A * 9/2000 Burdisso et al. ..... 60/226.1
6,149,477 A * 11/2000 Toyama ..... 440/88
6,286,472 B1 * 9/2001 Takahashi et al. ..... 123/184.34
6,296,536 B1 * 10/2001 Katayama et al. ..... 440/77
6,360,708 B2 * 3/2002 Hwang et al. ..... 123/184.57
6,422,192 B1 * 7/2002 Bloomer ..... 123/184.57
6,633,646 B1 * 10/2003 Hwang ..... 381/71.5
2002/0117138 A1 * 8/2002 Katayama ..... 123/184.55

FOREIGN PATENT DOCUMENTS

JP 02030970 A * 2/1990 ..... F02M/35/12
JP 02-030970 * 2/1990 ..... 440/88
JP 402-019419 * 3/1990 ..... 123/184.57
JP 03-229908 * 10/1991 ..... 123/184.39
JP 404-019314 * 1/1992 ..... 181/229
JP 04-209961 * 7/1992 ..... 181/229
JP 04259617 A * 9/1992 ..... F01N/1/06
JP 04262013 A * 9/1992 ..... F01N/1/02
JP 04262014 A * 9/1992 ..... F01N/1/02
JP 04262015 A * 9/1992 ..... F01N/1/02
JP 04262017 A * 9/1992 ..... F01N/7/08
JP 05-163925 * 6/1993 ..... 123/184.39
JP 05-272421 * 10/1993 ..... 123/184.39
JP 06-212942 * 8/1994 ..... 181/229
JP 406-221131 * 8/1994 ..... 181/212
JP 06-264838 * 9/1994 ..... 181/229
JP 406-249387 * 9/1994 ..... 181/212
SU 1265385 * 10/1986 ..... 123/184.57

* cited by examiner

AIR INTAKE SILENCER

BACKGROUND OF THE INVENTION

This invention relates generally to air intake silencers for use with internal combustion engines, and, more particularly, to air intake silencers for use with outboard motors.

Internal combustion engines typically include an air intake system for receiving combustion air that is mixed with fuel and combusted in the engine cylinders. Noise from the engine, however, also typically travels through the air intake system to the atmosphere. In certain engines, such as, for example, a two-stroke outboard motor, noise travelling from the engine through the air intake is a significant noise source when the engine is operated at high speeds.

To mitigate engine noise that travels through the air intake, two stroke outboard motors are often equipped with air intake silencers including expansion chambers or resonance chambers to attenuate engine noise traveling through the air intake. Due to size constraints in outboard motor constructions, however, known air intake silencers are of limited effectiveness. Typically, known air intake silencers produce attenuation of less than 4 dB, and are generally ineffective at frequencies below 500 Hz.

BRIEF SUMMARY OF THE INVENTION

In an exemplary embodiment of the invention, an air intake silencer includes at least one air inlet pipe comprising a first end, a second end, and a passage therethrough, and at least one tuning tube in fluid communication with the air inlet passage. The tuning tube includes a first end, a second end, and a passage therethrough that extends for a length selected to cancel noise of at least a first selected frequency passing through the air inlet pipe.

More specifically, the tuning tube and the air inlet pipe have passages of substantially equal diameters, but the passages extend for different path lengths through the air inlet pipe and the tuning tube. The path length difference causes half wavelength cancellation of a selected frequency of sound exiting from the air inlet pipe from an engine through the air intake silencer. In a further embodiment, the air intake silencer includes a plurality of tuning tubes located in a wrap-around relationship with one another to tune different frequencies and produce half wavelength cancellation of more than one frequency. The air inlet pipe and tuning tube may be integrally formed, and in different embodiments may be formed into an air intake manifold that silences more than engine air inlet. In one embodiment the air intake silencer is integral to a motor cover.

The above-described air intake silencer achieves broad band noise reduction of about 10 dB to about 20 dB in a frequency range of about 300 Hz to about 800 Hz.

DETAILED DESCRIPTION OF THE INVENTION

While the present invention is described in the context of an outboard motor system, and more particularly in the context of a two stroke outboard motor, the embodiments of the invention set forth herein are intended for illustrative purposes only. It is understood that the present invention is applicable to other types of outboard motors, e.g., a four stroke motor, as well as to other motor applications wherein air intake noise is desirably reduced. Therefore, the invention is not limited to practice with a particular motor or motor application.

Figure 1:
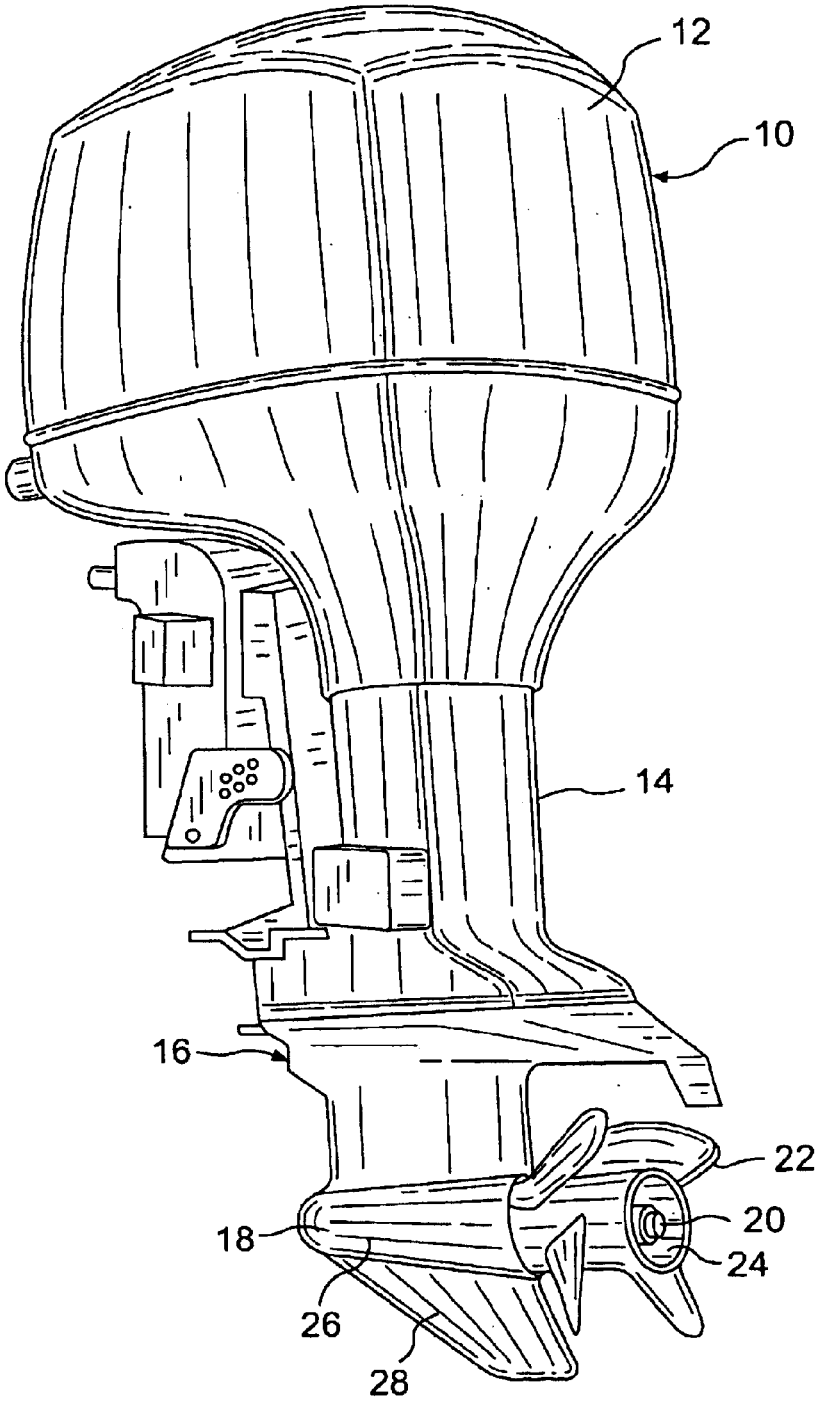
FIG. 1 is a perspective view of an exemplary outboard engine.

FIG. 1 is a perspective view of an exemplary outboard motor 10, such as an outboard engine commercially available from Outboard Marine Corporation, Waukegan, Ill. Motor 10 includes a cover 12 which houses a power head (not shown), an exhaust housing 14, and a lower unit 16. Lower unit 16 includes a gear case 18 which supports a propeller shaft 20. A propeller 22 is engaged to shaft 20. Propeller 22 includes an outer hub 24 through which exhaust gas is discharged. Gear case 18 includes a bullet, or torpedo, 26 and a skeg 28 which depends vertically downwardly from torpedo 26.

The power head includes an internal combustion engine (not shown in FIG. 1) having a drive shaft (not shown) which engages a gear set in gear case 18 and causes propeller shaft 20 to rotate. As propeller shaft 20 rotates, a thrust is developed to propel a watercraft (not shown) or vessel to which outboard motor 10 is attached. An air intake system (not shown in FIG. 1) includes an air inlet (not shown in FIG. 1) in flow communication with the atmosphere for intake combustion air in the cylinders of the engine. In one type of engine, intake air is passed through a carburetor before entering the cylinders. In another type of engine, air is passed into the engine cylinders and fuel is directly injected into the engine cylinders for combustion. In either type of engine, considerable engine noise is transmitted from the engine through the air intake air inlet to the atmosphere.

Figure 2:
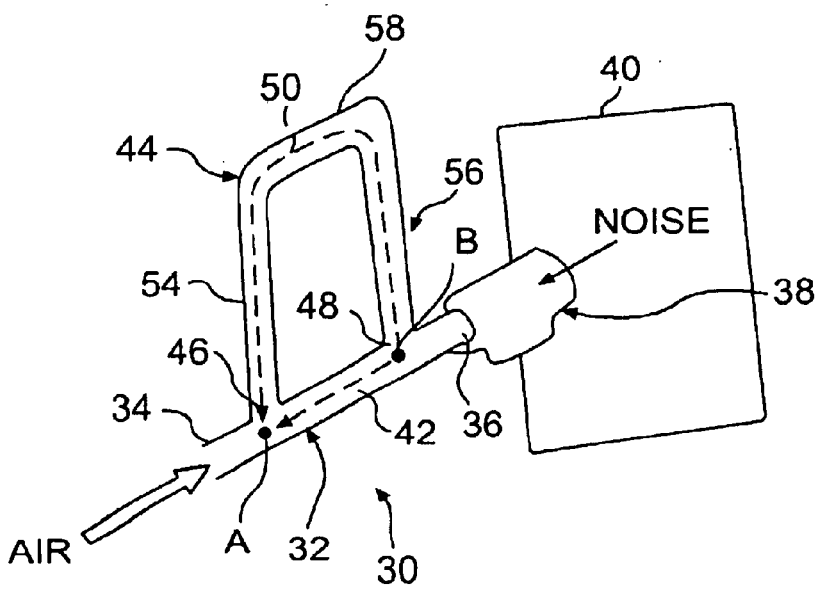
FIG. 2 is a schematic illustration of a first embodiment of an air intake silencer.

FIG. 2 illustrates one exemplary embodiment of an air intake silencer 30 for reducing transmission of engine noise therethrough. Air intake silencer 30 includes an air inlet pipe 32 in flow communication with the atmosphere at a first end 34, a second end 36 coupled to an engine air intake inlet 38 for passage of combustion air within an engine 40, and a passage 42 between first end 34 and second end 36 to establish fluid communication between first end 34 and second end 36.

In one embodiment, such as, for example, a two stroke outboard motor, such as motor 10 (shown in FIG. 1), air intake inlet 38 is an inlet to a carburetor (not shown) wherein atmospheric air traveling though air inlet pipe from first end 34 to second end 36 is mixed with fuel to form a combustible air/fuel mixture for combustion in the cylinders of engine 40. In an alternative embodiment, ambient air traveling though air inlet pipe 32 from first end 34 to second end 36 is routed to one or more engine cylinders through a valve (not shown), and fuel is injected into the cylinders to form a combustible air/fuel mixture.

A tuning pipe 44 extends from air inlet pipe 30 and also includes a first end 46, a second end 48, and a passage 50 therebetween establishing flow communication between first end 46 and second end 48. Tuning tube first and second ends 48, 48, respectively, are in flow communication with air inlet pipe passage 42 so that air inlet pipe passage 42 and tuning tube passage 50 intersect at a first joint "A" and a second joint "B" along inlet pipe passage 42. Air inlet pipe passage 42 extends a first lineal distance $L_1$ between joints "A" and "B" while tuning tube passage 50 extends a second lineal distance $L_2$ between joints "A" and "B." By appropriately selecting lengths $L_1$ and $L_2$, engine noise traveling from air intake inlet 38 and through air intake silencer 30 to the atmosphere may be attenuated.

In one embodiment, $L_1$ and $L_2$ are selected to produce one-half wavelength cancellation of noise traveling from engine 40 to the atmosphere through air intake silencer 30. By creating different noise path lengths through air inlet pipe passage 42 and tuning tube passage 50, air intake silencer 30 is tunable to a center frequency having a one-half wavelength equal to the difference of the two path lengths $L_1$ and $L_2$. In an exemplary embodiment of air intake silencer 30, $L_1$ is 5 inches (0.417 feet) and $L_2$ is 20 inches ( 1.67 feet), and considering that the speed of sound at an air temperature of 70° F. is 1128 ft/sec, then the center frequency that the air intake silencer is tuned to is $$F = \frac{1128}{2(L_2 - L_1)} = \frac{1128}{2(1.67 - 0.417)} = 450 \text{ Hz.} \qquad \text{(Eq. 1)}$$

In alternative embodiments, other lengths of $L_1$ and $L_2$ are selected to tune air intake silencer 30 to a different center frequency as desired to attenuate engine noise at another frequency. Unlike known air intake silencers, air intake silencer 30 is effective at attenuating noise having a frequency of about 500 Hz or less, which is particularly advantageous for use in a two stroke outboard motor.

In one embodiment, air inlet pipe 32 and air inlet pipe passage 42 are substantially straight and linear, and tuning tube 44 includes first and second segments 54 extending generally perpendicularly from air inlet pipe 32 and a third segment 58 extending between first and second legs 54, 56 substantially parallel to air inlet pipe 32. In one embodiment, tuning tube 44 is substantially U-shaped, with first and second segments 54, 56 forming the legs of the U and separated by the lineal distance $L_1$ between joints "A" and "B." In alternative embodiments, other shapes of tuning tube 44 and/or air inlet pipe 32 are employed, provided that lineal distances $L_1$, $L_2$ of air inlet passage 42 and tuning tube passage 50 produce a desired level of engine noise cancellation before the sound exits first end 34 of air inlet pipe 32 and disperses in the atmosphere. In further alternative embodiments, greater or fewer than three tuning tube segments 54, 56, 58 are employed, and more than one air intake silencer 30 may be used to silence noise from different engine cylinders.

Also, air inlet pipe 32 and tuning tube 44, in one embodiment are integrally formed and substantially equal in size, and consequently air inlet pipe 32 and tuning tube 44 include substantially similar passages 42, 50, respectively, in cross section. Thus, air intake silencer 30 is relatively compact in comparison to known silencers incorporating expansion chambers or resonance chambers. In alternative embodiments, however, a differently sized air inlet pipe 32 and tuning tubes 44 are used, and in a further alternative embodiment, air inlet pipe and tuning passages 42, 50 are lined with a known sound-attenuating material, such as felt, to further reduce noise transmission through air intake silencer 30. Still further, in yet another embodiment, tuning tube 44 and air inlet pipe 32 are combined with a conventional air intake silencer (not shown) or a conventional expansion chamber (not shown) to aggregate the benefits of the present invention to the advantages of known silencers.

Figure 3:
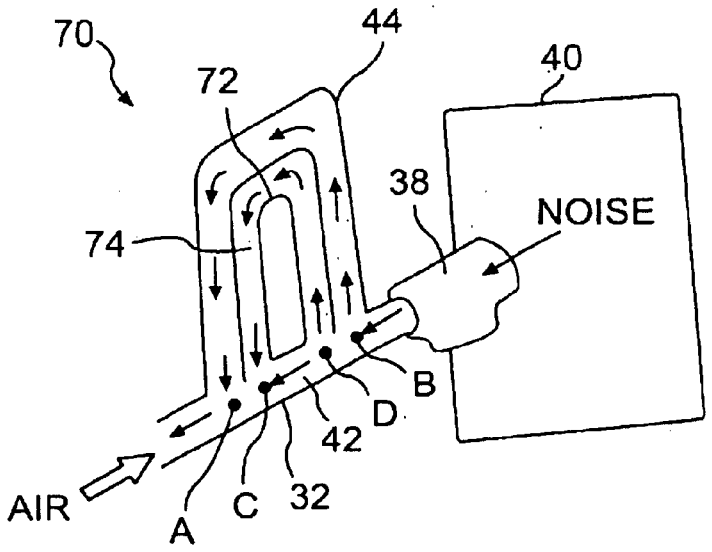
FIG. 3 is a schematic illustration of a second embodiment of an air intake silencer.

FIG. 3 is a schematic illustration of a second embodiment of an air intake silencer 70 similar to air intake silencer 30 (shown in FIG. 2) and including a second tuning tube 72 located in a wrap-around relationship to first tuning tube 44 (described above). Second tuning tube 72 is constructed similarly to first tuning tube 44 but includes a third passage 74 that intersects air inlet tube passage at joints "C" and "D." Similar to joints "A" and "B", inlet air pipe passage 42 extends a third lineal length $L_3$ between joints "C" and "D" and second tuning tube 72 extends a fourth lineal length $L_4$ that is different from lineal path length $L_3$. With strategic selection of $L_3$ and $L_4$ , one-half wavelength cancellation of engine noise at a second center frequency is achieved.

Hence, not only will air intake silencer 70 produce engine noise cancellation at a first center frequency determined by the path length difference of $L_2$ and $L_1$, as explained above, but also will attenuate noise at a second center frequency determined by a path length difference between $L_3$ and $L_4$. Applying equation (1) from above, the second center frequency is determined by the relationship:

$$F = \frac{1128}{2(L_4 - L_3)}.$$

With strategic selection of $L_3$ and $L_4$, noise components of frequencies above and below the first center frequency in respective alternative embodiments are achievable.

While first and second tuning tubes 44, 72 are illustrated in a wrap-around relationship to produce a compact silencer 70, in alternative embodiments, first and second tuning tubes 44, 72 need not be located proximally to one another. Also, in one embodiment, air inlet pipe 32 and first and second tuning tubes are integrally formed, while in alternative embodiments air inlet pipe 32 and tuning tubes 44, 72 are separately constructed. In still further alternative embodiments, more than two tuning tubes are further used to expand an operating range of engine noise frequency attenuation.

Figure 4:
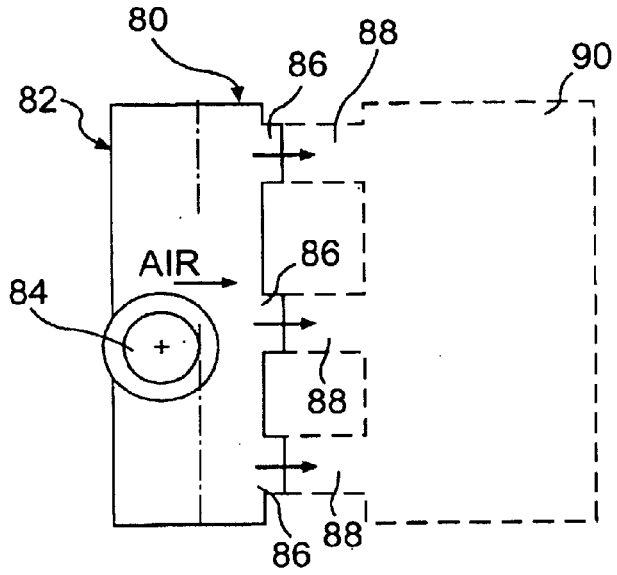
Figure 4 is an elevational view of a third embodiment of an air intake silencer.
Figure 5:
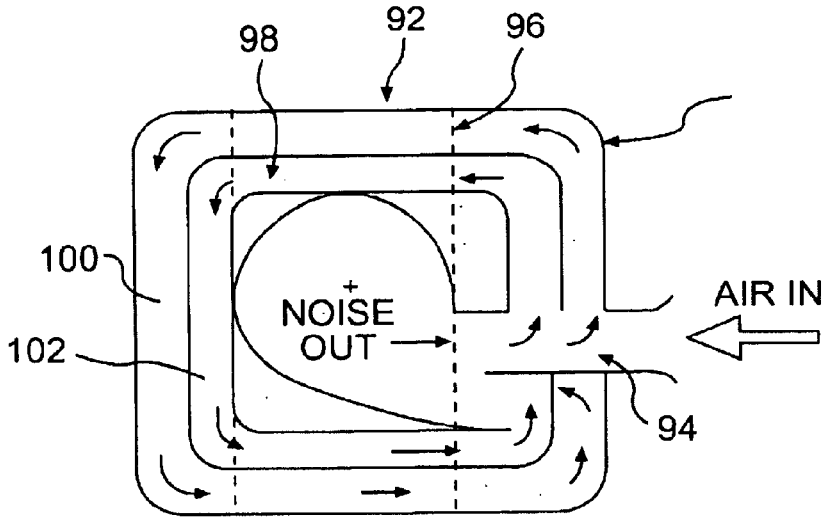
FIG. 5 is a schematic sectional illustration of the air intake silencer shown in FIG. 4.

FIGS. 4 and 5 are elevational and schematic sectional illustrations, respectively, of a third embodiment of an air intake silencer 80 in the form of an air intake manifold 82. Manifold 82 includes at least one air intake inlet 84 in communication with the atmosphere or ambient air, and a plurality of manifold outlets 86 in communication with engine air intake inlets 88 (shown in phantom in FIG. 4) of an internal combustion engine 90 (shown in phantom in FIG. 4). As noted above, engine 90 may or may not include a carburetor (not shown) between manifold outlets 86 and the cylinders of engine 90. Intake air from the atmosphere flows through manifold air intake inlet 84 and into engine air intake inlets 88 for combustion in the cylinders.

To attenuate engine noise from traveling through manifold 80 to the ambient environment, manifold 80 contains an embedded air intake silencer 92 including an air inlet pipe 94, a first tuning tube 96, and a second tuning tube 98. First and second tuning tubes 96, 98 include an air passage or path 100, 102, respectively, having a respective lineal length, and the lineal path lengths are strategically selected to produce engine noise cancellation at a center frequency determined by equation (1) above. In alternative embodiments, greater or fewer than two tuning tubes are used to produce one-half wave length cancellation of noise emanating from the engine and traveling though the manifold to the atmosphere.

More than one air intake silencer manifold 82 may be used to silence engine noise through, for example, an odd cylinder bank (not shown) or an even cylinder bank (not shown), and in a further embodiment, an integrated manifold is constructed with more than one silencer so as to silence engine noise emanating from engine cylinders in different cylinder blocks or cylinder banks. In one embodiment, manifolds 82 are constructed differently so as to silence noise at different frequencies relative to respective cylinder blocks, or to silence noise of particular cylinders at different frequencies. In still a further embodiment, one or more manifolds 82 are structurally integrated into engine 90. In yet another embodiment, manifold 82 is a separate component from engine 90.

Figure 6:
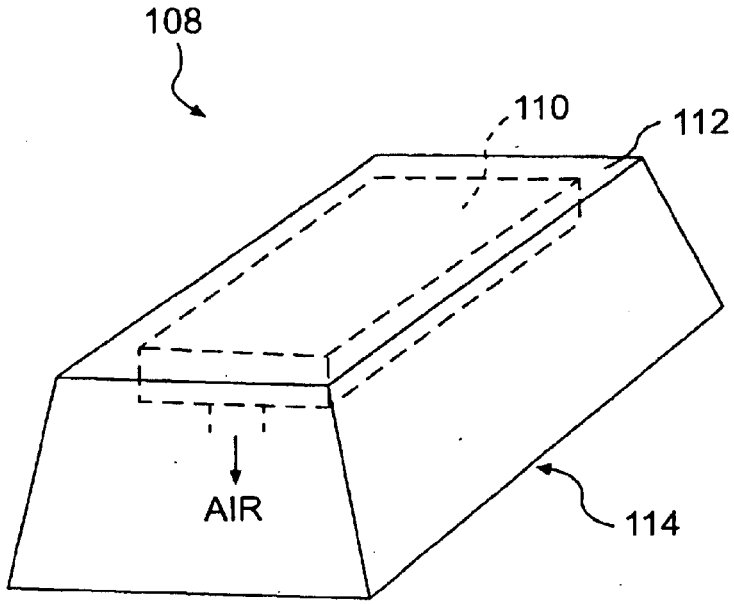
FIG. 6 is a schematic illustration of a first embodiment of an engine cover incorporating an air intake silencer.

FIG. 6 is a schematic illustration of a first exemplary embodiment of an engine cover 108 for an outboard motor, such as motor 10 (shown in FIG. 1), incorporating an air intake silencer 110 such as one of silencers 30, 70 or 80 (shown and described above). Air intake silencer 110 is integrally formed into a top wall 112 of an upper half 114 of motor cover 12 (shown in FIG. 1).

Figure 7:
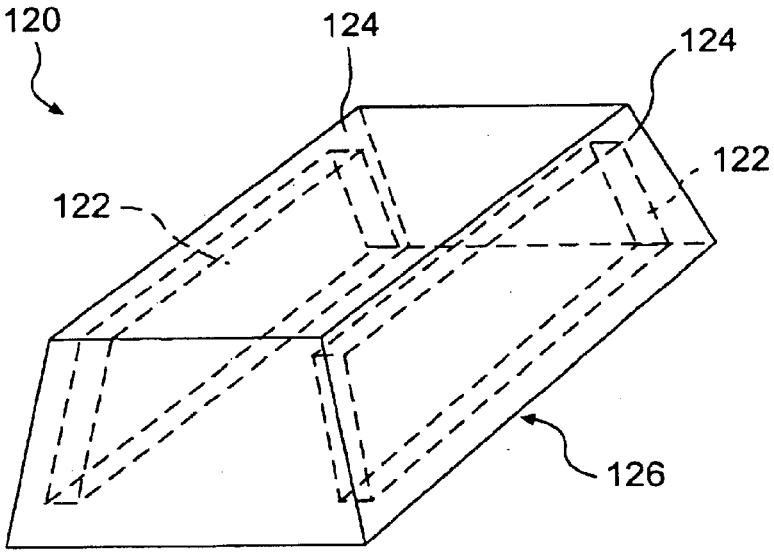
FIG. 7 is a schematic illustration of a second embodiment of an engine cover incorporating an air intake silencer.

FIG. 7 is a schematic illustration of a second exemplary embodiment of an engine cover 120 for an outboard motor, such as motor 10 (shown in FIG. 1), incorporating a pair of air intake silencers 122, such as silencers 30, 70 or 80 (shown and described above). Air intake silencers 122 are integrally formed into a side walls 124 of an upper half 126 of motor cover 12 (shown in FIG. 1).

Figure 8:
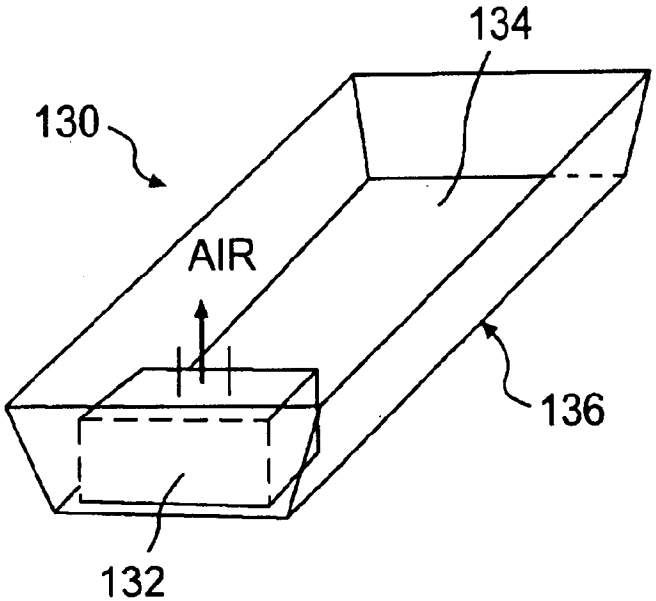
FIG. 8 is a schematic illustration of a third embodiment of an engine cover incorporating an air intake silencer.

FIG. 8 is a schematic illustration of a third exemplary embodiment of an engine cover 130 for an outboard motor, such as motor 10 (shown in FIG. 1), incorporating an air intake silencer 132, such as one of silencers 30, 70 or 80 (shown and described above). Air intake silencer 132 is integrally formed into a bottom wall 124 of a lower half 126 of motor cover 12 (shown in FIG. 1).

FIG. 8 is a schematic illustration of a third exemplary embodiment of an engine cover 130 for an outboard motor, such as motor 10 (shown in FIG. 1), incorporating an air intake silencer 132, such as one of silencers 30, 70 or 80 (shown and described above). Air intake silencer 132 is integrally formed into a bottom wall 134 of a lower half 136 of motor cover 12 (shown in FIG. 1).

In further alternative embodiments, more than one intake silencer, such as silencers 30, 70 or 80 (shown and described above) or combinations of air intake silencers 30, 70, or 80, are formed integrally into the same or different walls of upper or lower halves, respectively, of an engine cover. In still further embodiments, one or more air intake silencers are separately formed and attached to the upper or lower halves, respectively of the engine cover.

Using the above described embodiments, broad band noise reduction of about 10 dB to about 20 dB in a frequency range of about 300 Hz to about800 Hz may be achieved, a notable increase over known air intake silencers. Moreover, broad band noise reduction is provided in a compact air silencer unit especially advantageous for two stroke outboard motors.

While the invention has been described in terms of various specific embodiments, those skilled in the art will recognize that the invention can be practiced with modification within the spirit and scope of the claims.

What is claimed is:

1. A cover for an outboard motor comprising:

a lower cover;

an upper cover configured for attachment to said lower cover; and at least one air intake silencer attached to one of said upper cover and said lower cover and comprising:

at least one air inlet pipe comprising a first end, a second end, and an inlet passage therethrough; and at least one tuning tube comprising a first end, a second end, and a tuning passage therethrough, said tuning passage in fluid communication with said inlet passage and extending for a length selected to cancel noise of at least a first selected frequency passing through said inlet pipe.

2. A cover in accordance with claim 1 wherein said upper cover comprises a top wall, said at least one air intake silencer attached to said top wall.

3. A cover in accordance with claim 1 wherein each of said upper, cover and said lower cover comprises at least one side wall, said at least one air intake silencer attached to at least one side wall of said upper cover and said lower cover.

4. A cover in accordance with claim 3 wherein said lower cover comprises a bottom wall, said at least one air intake silencer attached to said bottom wall.

5. A cover in accordance with claim 1 wherein said at least one air inlet pipe and said at least one tuning tube comprise an air intake manifold.

6. A cover in accordance with claim 1 wherein said air inlet pipe is straight.

7. A cover in accordance with claim 6 wherein said tuning tube comprises a first segment in flow communication with said inlet passage, a second segment in flow communication with said inlet passage, and a third segment extending between said first segment and said second segment and in flow communication with said first segment and said second segment.

8. A cover in accordance with claim 7, said first segment and said second segment are separated from one another along an axis of said inlet pipe.

9. A cover in accordance with claim 1 wherein said tuning tube and said air inlet pipe have substantially equal diameters.

10. A cover in accordance with claim 1 further comprising at least another tuning tube in a wrap-around relationship with said at least one tuning tube.

11. A cover in accordance with claim 1 wherein said at least one air inlet pipe and said at least one tuning tube are integrally formed.

12. An outboard motor engine comprising:

a motor cover;

at least one air inlet for engine intake air; and an air intake silencer coupled to said air inlet and integrally formed with said motor cover, said air intake silencer comprising at least one air inlet pipe coupled to said air inlet and at least one tuning tube in flow communication with said air inlet pipe, said air inlet pipe and said tuning tube configured to cancel a portion of sound traveling through said air inlet pipe.

13. An outboard motor engine in accordance with claim 12 wherein said air inlet pipe is straight.

14. An outboard motor engine in accordance with claim 12 wherein said tuning tube comprises a first segment in flow communication with an inlet pipe passage, a second segment in flow communication with said inlet pipe passage, and a third segment extending between said first segment and said second segment and in flow communication with said first segment and with said second segment.

15. An outboard motor engine in accordance with claim 14 wherein said first segment and said second segment are separated from one another along an axis of said inlet pipe.

16. An outboard motor engine in accordance with claim 12 wherein said tuning tube and said air inlet pipe have substantially equal diameters.

17. An outboard motor engine in accordance with claim 12 further comprising at least another tuning tube, said at least another tuning tube in a wrap-around relationship with said at least one tuning tube.

18. An outboard motor engine in accordance with claim 12 wherein said at least one air inlet pipe and said at least one tuning tube are integrally formed.

19. An outboard motor engine in accordance with claim 18 wherein said air inlet pipe and said at least one tuning tube comprise an air intake manifold.

20. An air intake silencer comprising:

an air inlet tube having an inlet, an outlet, a first opening, and a second opening space a distance from the first opening and of substantially similar size to the first opening;

a tuning tube connected between the first opening and the second opening of the air inlet tube and having a length greater than the distance between the first and second openings in the inlet tube and arranged such that noise traveling simultaneously into the tuning tube and through the inlet tube converge at the second opening; and wherein the air intake silencer is incorporated into an outboard engine.

21. The air intake silencer of claim 20 wherein the length of the tuning tube is longer than the length between the first and second openings in the air inlet tube such that noise traveling through the tuning tube exits the tuning tube about one-half wavelength behind noise traveling through the air intake tube.

22. The air intake silencer of claim 20 wherein the tuning tube is in continual communication with the air intake tube.

* * * * *